US007335119B2

(12) United States Patent
White

(10) Patent No.: US 7,335,119 B2
(45) Date of Patent: Feb. 26, 2008

(54) RATCHET ELEVATOR SYSTEM

(75) Inventor: Ronald White, North Prairie, WI (US)

(73) Assignee: Russell Corporation, Atlanta, GA (US)

( * ) Notice: Subject to any disclaimer, the term of this patent is extended or adjusted under 35 U.S.C. 154(b) by 221 days.

(21) Appl. No.: 11/238,132

(22) Filed: Sep. 29, 2005

(65) Prior Publication Data

US 2007/0072706 A1 Mar. 29, 2007

(51) Int. Cl.
*A63B 63/08* (2006.01)

(52) U.S. Cl. ..... 473/483; 473/481

(58) Field of Classification Search ..... 473/480–485, 473/477

See application file for complete search history.

(56) References Cited

U.S. PATENT DOCUMENTS

| | | | | |
|---|---|---|---|---|
| 78,570 | A | | 6/1868 | Bragg |
| 169,382 | A | | 11/1875 | Starr |
| 171,746 | A | | 1/1876 | Starr |
| 213,775 | A | | 4/1879 | Redman et al. |
| 289,653 | A | | 12/1883 | Haynes |
| 325,551 | A | | 9/1885 | Lukens |
| 446,464 | A | | 2/1891 | Nittinger |
| 480,261 | A | | 8/1892 | Herr |
| 482,207 | A | | 9/1892 | Streeter |
| 532,132 | A | | 1/1895 | Zaremba |
| 806,790 | A | | 12/1905 | Foersterling |
| 876,525 | A | | 1/1908 | Chrichester |
| 1,050,672 | A | | 1/1913 | Macintosh |
| 1,139,581 | A | | 5/1915 | Riley |
| 1,924,811 | A | | 8/1933 | Schulz |
| 1,988,037 | A | | 1/1935 | Furrer |
| 2,227,310 | A | * | 12/1940 | Hoppes et al. ..... 473/481 |
| 2,313,188 | A | | 3/1943 | Woodburn |
| 2,379,572 | A | | 7/1945 | Gibson |
| 2,391,872 | A | | 1/1946 | Berg |
| 2,557,604 | A | | 6/1951 | Invidiato |
| 2,784,770 | A | | 3/1957 | Herr |
| 2,986,395 | A | | 5/1961 | Sheftel |
| 3,017,183 | A | | 1/1962 | Chalcroft |
| 3,237,902 | A | | 3/1966 | Hayashi |
| 3,329,427 | A | | 7/1967 | Bearson |
| 3,341,197 | A | | 9/1967 | Bottorff |
| 3,352,580 | A | | 11/1967 | Kurz et al. |
| 3,368,847 | A | | 2/1968 | Langmead |
| 3,462,102 | A | | 8/1969 | Rivers |

(Continued)

FOREIGN PATENT DOCUMENTS

| | | |
|---|---|---|
| WO | WO 99/38579 | 8/1999 |

(Continued)

*Primary Examiner*—Eugene Kim
*Assistant Examiner*—M. Chambers

(57) ABSTRACT

The present invention is related to a system and method for adjusting the height of a basketball backboard assembly. The present invention includes a releasable locking mechanism connected to the backboard assembly to lock the backboard at a selected vertical height above a playing surface. In one embodiment of the present invention, the releasable locking mechanism may include a ratchet and cam, the ratchet having a plurality of ratchet teeth configured to engage with a pawl. A cam may be configured to allow a user to incrementally increase the height of the backboard using the releasable locking mechanism and may further be configured to prevent the releasable locking mechanism locking the backboard at any height when a user desires to decrease the height of the backboard.

6 Claims, 9 Drawing Sheets

U.S. PATENT DOCUMENTS 3,467,377 A 9/1969 Miller et al.
3,490,727 A 1/1970 Miller
3,586,324 A 6/1971 Bearson
3,614,099 A 10/1971 Sarno
3,765,676 A 10/1973 Bearson
3,802,702 A 4/1974 Pulley
3,880,392 A 4/1975 Duganich
4,145,044 A 3/1979 Wilson et al.
4,151,989 A 5/1979 Dittrich
4,311,338 A 1/1982 Moorhouse
4,330,101 A 5/1982 Andersen
4,395,040 A 7/1983 White
4,412,679 A 11/1983 Mahoney
4,465,277 A 8/1984 Dittrich
4,640,549 A 2/1987 Yokota
4,684,129 A 8/1987 Andersen et al.
4,770,463 A 9/1988 Nishino
4,781,375 A 11/1988 Nye
4,793,611 A 12/1988 Thornell
4,798,381 A * 1/1989 Dadbeh ..... 473/484
4,805,904 A 2/1989 Nye
4,828,323 A 5/1989 Brodersen et al.
4,881,734 A 11/1989 Nye
5,082,261 A 1/1992 Pelfrey
5,133,547 A 7/1992 Pardi
5,211,393 A 5/1993 Rolffs et al.
5,292,118 A * 3/1994 Allen et al. ..... 473/484
5,324,027 A 6/1994 Nye
5,375,835 A 12/1994 Van Nimwegen et al.
5,377,976 A 1/1995 Matherne et al.
5,401,015 A 3/1995 Woodall
5,462,269 A 10/1995 Schroeder et al.
5,465,957 A * 11/1995 Schroeder ..... 473/484
5,478,068 A 12/1995 Schroeder
5,484,127 A 1/1996 Mower et al.
5,503,390 A * 4/1996 Hall ..... 473/484
5,540,429 A 7/1996 Dalebout et al.
5,601,284 A 2/1997 Blackwell et al.
5,695,417 A 12/1997 Winter et al.
5,720,679 A 2/1998 Schroeder
5,738,601 A * 4/1998 Hughes ..... 473/484
5,772,167 A 6/1998 Koole
5,800,296 A 9/1998 Shaw
5,823,898 A 10/1998 Wang
5,826,846 A 10/1998 Buccieri et al.
5,879,247 A 3/1999 Winter et al.
6,077,177 A * 6/2000 Winter et al. ..... 473/484
6,120,396 A * 9/2000 Van Nimwegen et al. .. 473/484
6,155,938 A 12/2000 Mower
6,273,834 B1 8/2001 Winter
6,283,878 B1 9/2001 White
6,402,644 B2 6/2002 Stanford et al.
6,419,597 B1 7/2002 Van Nimwegen et al.
6,422,957 B1 7/2002 Winter et al.
6,645,095 B1 * 11/2003 Nye et al. ..... 473/484
6,699,146 B1 3/2004 Winter et al.
2001/0024984 A1 * 9/2001 Stanford et al. ..... 473/484
2002/0094890 A1 7/2002 White et al.
2006/0276273 A1 * 12/2006 Perry et al. ..... 473/481

FOREIGN PATENT DOCUMENTS

WO WO 2004/058362 7/2004

* cited by examiner

RATCHET ELEVATOR SYSTEM

FIELD OF THE INVENTION

The present invention is related to an apparatus and method for adjusting the height of a basketball backboard assembly.

BACKGROUND OF THE INVENTION

Basketball has become an increasingly popular sport, with backyard and neighborhood basketball goals increasing in popularity. These backyard basketball goals often function well for families and communities with a wide variety of people playing the game, including grown adults and small children. Consequently, adjustable height basketball goals have become a favorite product in backyard or personal basketball courts as they allow individuals of various heights and skill levels to play on the same basketball goal.

Many adjustable height basketball goals have been proposed for accomplishing incremental adjustment of the vertical height of a basketball backboard assembly. Such arrangements may often incorporate a parallelogram type support frame capable of permitting vertical movement of the backboard while maintaining a parallel relationship between the basketball rim and a playing surface. Additionally, various releasable locking arrangements have been proposed for holding the backboard assembly at a desired height.

In many of these prior art systems, for a user to lower the height of the backboard assembly, the user must manually disengage a latch or other locking mechanism. Disengaging the latch permits the user to lower or raise the backboard until the goal is located at the desired height. The latch must then be engaged in order to lock the goal height. Other devices such as levers and/or switches, located behind the backboard and/or on handles extending down from the backboard, may activate the latch. Often, the latch needs to be activated and held open while adjusting the height of the backboard assembly. This may be especially difficult for some individuals, especially smaller children attempting to make height adjustments when the backboard is locked at its maximum height.

Unfortunately, many prior art systems are complex and expensive, requiring multiple moving parts to control movement and lock the backboard in place. To reduce the complexity of the basketball goal elevator systems, some basketball goal assemblies include a ratchet system allowing the backboard and goal to be ratcheted up incrementally. A pole or other such element may be used to push the assembly upward.

Unfortunately, upon reaching the last ratchet or the highest position, previous systems failed to return to the lowest height without manually disengaging the ratchet. In traditional systems, the disengaging of the ratchet included the use of an end of a long pole to disengage the pawl from the teeth of the ratchet before the backboard could be lowered. Once disengaged, the backboard would fall under its own weight to its lowest position before it was capable of being ratcheted up to a desired height. However, the release of the pawl typically required precise and difficult positioning of the end of the pole on the pawl located underneath or behind the backboard. This positioning of a pole may be especially difficult due to the small target that the pawl presents, a situation that may be made worse when the backboard is at the highest position.

Furthermore, for some individuals, such as small children, the effort of positioning a long pole to both disengage the pawl and lower the weight of the backboard may be quite difficult. As a result, some individuals may be discouraged from changing the height of the backboard due to the difficulty of accurately releasing the pawl.

Therefore, there is a need for an adjustable basketball backboard assembly that can be incrementally adjusted and easily lowered by individuals of various heights and skill levels.

SUMMARY OF THE INVENTION

The present invention is related to an apparatus and method for adjusting the height of a basketball backboard assembly.

One embodiment of the present invention includes a system for adjusting the height of a sports apparatus above a playing surface. The system may include a support element, a sports apparatus having at least a first position above the playing surface and a second position above the playing surface, the first position being lower than the second position, and at least one arm rotatably connected to the sports apparatus and rotatably connected to the support element. The system may also include a locking mechanism connected to the at least one arm and configured to permit the sports apparatus to move from the first position to the second position and to hold the sports apparatus at the first position and at the second position and a release element. The system may be configured so that the application of an upward force to the sports apparatus when the sports apparatus is at the first position causes the locking mechanism to permit the sports apparatus to move to the second position and the application of an upward force to the sports apparatus when the sports apparatus is at the second position causes the release element to unlock the locking mechanism to permit the sports apparatus to move from the second position to the first position.

Another embodiment of the present invention may include a system for adjusting the height of a sports apparatus above a playing surface. The system may include a support element, a sports apparatus having at least a first position above the playing surface and a second position above the playing surface, the first position being lower than the second position, and at least one arm rotatably connected to the sports apparatus and rotatably connected to the support element. The system may also include means for maintaining the position of the sports apparatus at the first position and at the second position, the means for maintaining the position of the sports apparatus being further configured to permit the sports apparatus to move from the first position to the second position and means for releasing the sports apparatus from the second position. The system may be configured so that the application of an upward force to the sports apparatus when the sports apparatus is at the first position causes the means for maintaining the position of the sports apparatus to permit the sports apparatus to move to the second position and the application of an upward force to the sports apparatus when the sports apparatus is at the second position causes the means for releasing the sports apparatus to cause the means for maintaining the position of the sports apparatus to permit the sports apparatus to move from the second position to the first position.

Another embodiment of the present invention may include an elevator system for adjusting the height of a basketball backboard above a playing surface. The system may include a basketball support element, a basketball backboard having at least a first position above the playing surface and a second position above the playing surface, the first position being lower than the second position, and at least one elevator arm rotatably connected to the backboard and rotatably connected to the basketball support element. The system may also include a ratchet having a plurality of ratchet teeth, the ratchet being rigidly connected to the at least one elevator arm, a pawl, the pawl being in engageable relation with the plurality of ratchet teeth when the backboard is at both the first position and the second position and capable of maintaining a position of the backboard above the playing surface and a cam rotatably connected to the ratchet and the backboard. The system may be configured so that the application of an upward force to the backboard when the backboard is at the first position causes the backboard to move to the second position and the application of an upward force to the backboard when the backboard is at the second position causes the cam to disengage the pawl from the ratchet, preventing the pawl from engaging with the plurality of ratchet teeth and permitting the backboard to move from the second position to the first position.

Another embodiment of the present invention may include a method for adjusting the height of a basketball goal above a playing surface, the basketball goal having a backboard supported by a basketball support element and at least one elevator arm rotatably connected to both the support element and the backboard. The method may include the steps of securing the backboard at a first position by engaging a pawl with the teeth of a ratchet attached to the at least one elevator arm, applying an upwards force to the backboard to incrementally increase the height of the backboard above a playing surface until the backboard reaches a second position, whereupon a cam disengages the pawl from the ratchet teeth, lowering the backboard to the first position; and securing the backboard at the first position by engaging the pawl with the teeth of the ratchet.

These and other objects and advantages of the invention will be apparent from the following description, the accompanying drawings and the appended claims.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE INVENTION

The present disclosure will now be described more fully with reference to the Figures in which various embodiments of the present invention are shown. The subject matter of this disclosure may, however, be embodied in many different forms and should not be construed as being limited to the embodiments set forth herein.

Figure 1:
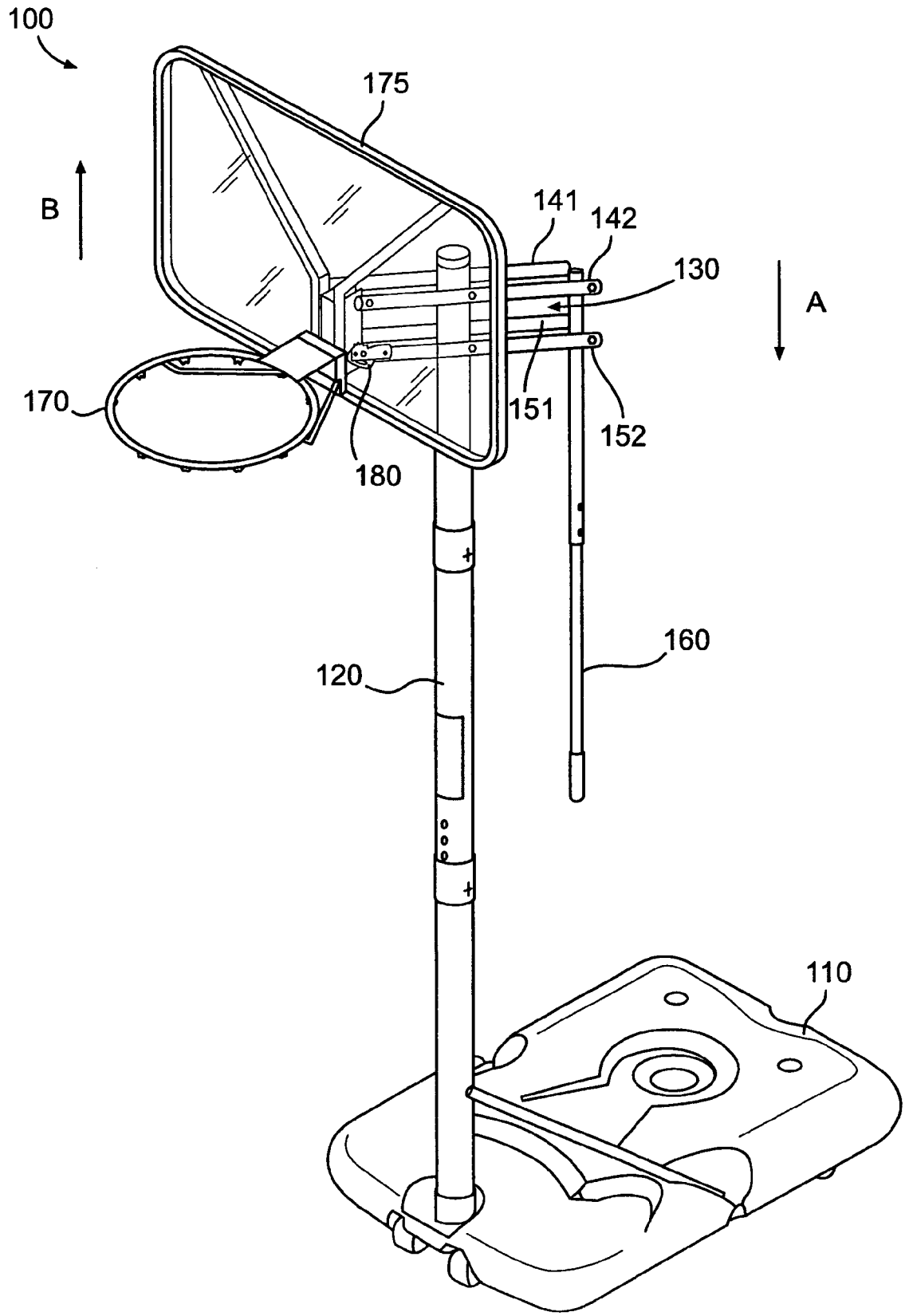
FIG. 1 shows an adjustable basketball goal system according to an embodiment of the present invention.

FIG. 1 shows an adjustable basketball goal system 100 according to an embodiment of the present invention. The basketball goal system 100 may include a rigid support pole 120 extending from a base 110 in a substantially upward direction. While the embodiment in FIG. 1 illustrates the use of a movable base 110, the system may also be used where the basketball support pole 120 is fixed with respect to the playing surface (not shown). While the playing surface may be taken generally to mean the earth, it is also contemplated that the basketball support pole 120 may be fixed in concrete, an indoor floor of the type found in gymnasiums, asphalt or any basketball playing surface as would be known by one of skill in the art.

Additionally, while FIG. 1 illustrates the use of a pole 120 for supporting the basketball goal system 100, it is further contemplated that the basketball goal system may be attached to any type of support element without deviating from the scope and spirit of the present invention. These support elements may include, for example, the wall of a building, a pre-existing post or any similar element to which a basketball goal system may be attached.

A basketball backboard 175 and hoop 170 may be attached to the basketball support pole 120 by an adjustable frame 130. The adjustable frame 130 comprises two upper elevator arms 141, 142 and two lower elevator arms 151, 152. While two upper elevator arms 141, 142 and two lower elevator arms 151, 152 are illustrated in FIG. 1, it is contemplated that any number of upper or lower elevator arms may be used depending on the desired strength and rigidity of the system.

Each of the upper elevator arms 141, 142 and each of the lower elevator arms 151, 152 may be rotatably connected to the support pole 120 using pins, screws, brackets or any other means known to one of skill in the art. Further, a first end of each of the upper elevator arms 141, 142 and a first end of each of the lower elevator arms 151, 152 may be rotatably connected to the basketball backboard 175 using pins, screws, brackets or any other means known to one of skill in the art. As shown in FIG. 1, the upper elevator arms 141, 142 and the lower elevator arms 151, 152 may extend beyond the support pole 120 such that a second end of each of the upper elevator arms 141, 142 and a second end of each of the lower elevator arms 151, 152 are rotatably connected to an adjustment pole 160 using pins, screws, brackets or any other means known to one of skill in the art. The embodiment illustrated in FIG. 1 may also include a ratchet and cam system 180 for incrementally raising and lowering the height of the basketball backboard 175 and hoop 170 with the aid of the adjustment pole 160.

While FIG. 1 shows an adjustment pole 160 rotatably attached to the second end of each of the elevator arms 141, 142, 151, 152, it is contemplated that any suitable type of adjustment pole may be used for adjusting the height of the basketball backboard 175 and hoop 170. For example, in one embodiment, the adjustment pole may be a removable adjustment pole having one end configured to engage with the second end of any of the elevator arms 141, 142, 151, 152. In another embodiment, the adjustment pole may be a removable adjustment pole having a hook or other similar mechanism for allowing a user to pull the second end of any of the elevator arms 141, 142, 151, 152 in the direction indicated by Arrow A.

Additionally, while FIG. 1 shows elevator arms 141, 142, 151, 152 extending beyond support pole 120, it is contemplated that the elevator arms may rotatably connect to the support pole 120 without extending beyond the support pole 120. In this embodiment, it is contemplated that any suitable adjustment pole may be used to exert a force on the basketball backboard 175, hoop 170 or any of the elevator arms 141, 142, 151, 152 in the direction of Arrow B to raise the basketball backboard 175 and hoop 170. Further, it is contemplated that any mechanism that allows a user to exert a force in the direction of Arrow B on the basketball backboard 175 and hoop 170 may be used in lieu of an adjustment pole. For example, the user may use a pole, a basketball, a block of wood or even the user's own hands to exert force on the basketball backboard 175 and hoop 170.

As shown in FIG. 1, a releasable locking mechanism in the form of a ratchet and cam system 180 may be located at one of the rotatable connections between the lower elevator arms 151, 152 and the basketball backboard 175. The ratchet and cam system 180 may be used to secure the backboard 175 and hoop 170 at multiple pre-selected vertical heights above the ground or playing surface. While the figures illustrate a ratchet and cam system 180 connected at one of the rotatable connections between the lower elevator arms 151, 152 and the basketball backboard 175, it is contemplated that the ratchet and cam system 180 may be connected at any point where either of the upper elevator arms 141, 142 or either of the lower elevator arms 151, 152 are rotatably connected to the basketball backboard 175. Additionally, it is contemplated that the ratchet and cam system 180 may be connected at any of the rotatable connections on the adjustable frame 130. These rotatable connections may include, for example, the points at which either of the upper elevator arms 141, 142 or either of the lower elevator arms 151, 152 are rotatably connected to the support pole 120. Finally, it is contemplated that more than one ratchet and cam system 180 may be used at any number of the rotatable connections discussed above to add additional strength and stability to the elevator system.

Figure 2:
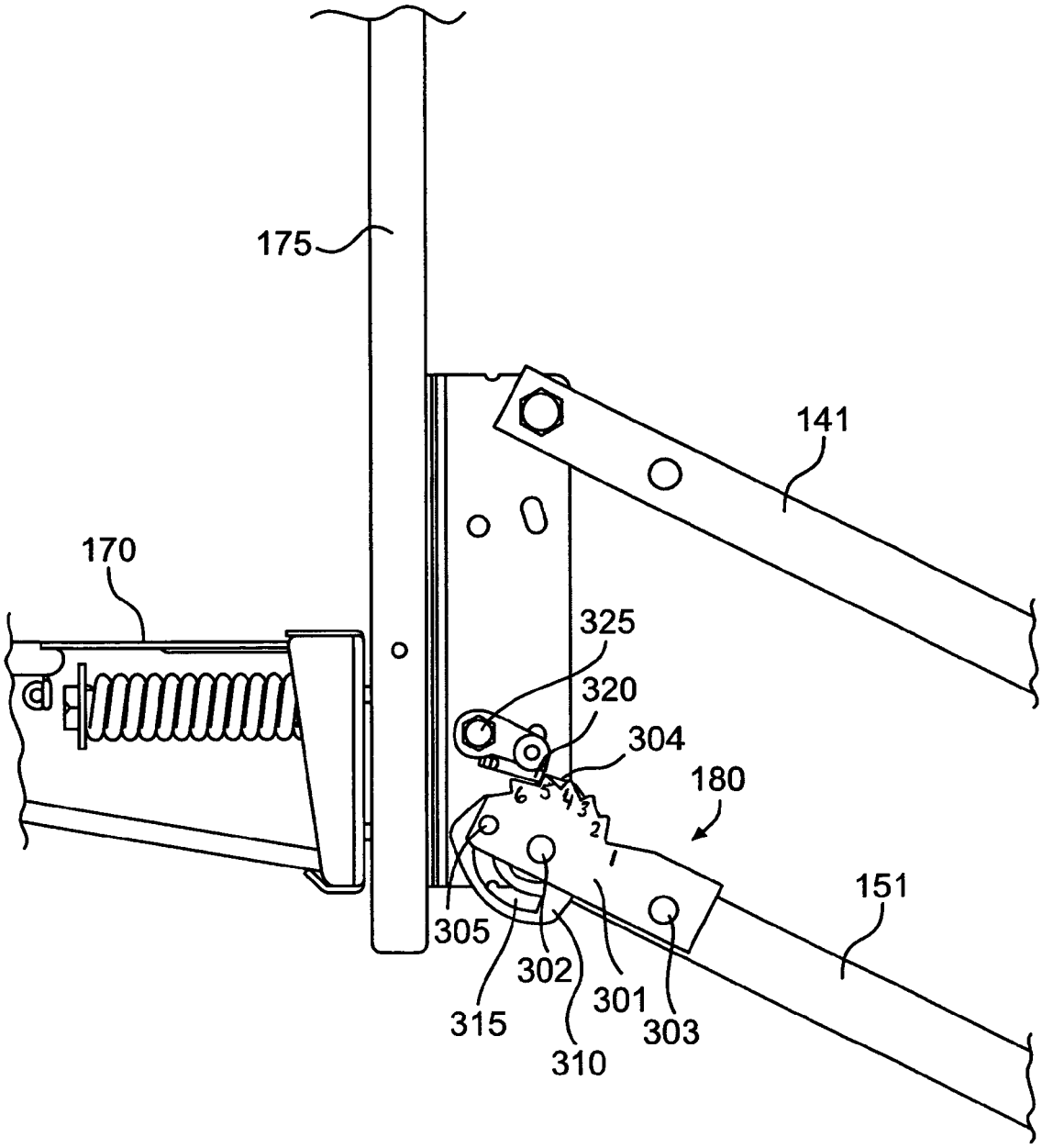
FIG. 2 shows a side view of the various components of the present invention.

FIG. 2 shows a side view of the various components of one embodiment of the present invention. As illustrated in FIG. 2, a ratchet 301 is rigidly attached to lower elevator arm 151 using a pin 303. It is also contemplated that screws, brackets or any other means known to one of skill in the art may be used to attach ratchet 301 to lower elevator arm 151. While FIG. 2 illustrates a single ratchet 301 attached to the outside of lower elevator arm 151, it is also contemplated that a single ratchet 301 may be attached to the inside of lower elevator arm 151 (as illustrated in FIGS. 3A-3E). Further, the ratchet 301 may be configured as an extension of the lower elevator arm 151, with two sets of ratchets positioned on either side of the lower elevator arm 151. Additionally, as would be apparent to one of skill in the art, the lower elevator arm 151 may extend to pin 302 and be rotatably connected to the backside of the basketball backboard 175 directly.

A pin 302 may be used to rotatably connect the ratchet 301 and a cam 310 to the basketball backboard 175. It is also contemplated that screws, brackets or any other means known to one of skill in the art may be used to attach the ratchet 301 and cam 310 to the basketball backboard 175. The cam 310 includes an elongated slot 315 configured to receive a pin 305 which is connected to the ratchet 301. The pin 305 may serve to confine the rotation of the cam 310 about pin 302 to approximately 90 degrees with respect to the ratchet 301.

A pawl 320 may be rotatably attached to basketball backboard 175 using a pin 325 or screws, bolts or any other means known to one of skill in the art. The pawl 320 is configured to engage with a toothed edge 304 of ratchet 301. The force of gravity may be used to urge the pawl 320 into engagement with one of the teeth 1-6 of the toothed edge 304 on the ratchet 301. Additionally, a spring (not shown) or other biasing means may be used to forcibly bias the pawl 320 in a downward direction into engagement with one of the teeth 1-6 of the toothed edge 304. While FIG. 2 shows the toothed edge 304 as having six teeth, it is contemplated that any number of teeth may be used without deviating from the scope and spirit of the present invention.

Further, while the figures illustrate the use of a pawl 320 engaging with a ratchet 301 for incrementally adjusting and locking the height of the basketball backboard 175, it is also contemplated that additional mechanical arrangements may be used (not shown). This may include, for example, a series of holes located on either the backboard 175 or one of the elevator arms 141, 151 which are adapted to receive a spring-loaded pin. Additionally, this may include a series of slots or cutouts located on either the backboard 175 or one of the elevator arms 141, 151 adapted to receive a spring-loaded blade. In any of these embodiments, the incremental adjustment of the backboard may be accomplished in the same manner as described below without deviating from the scope and spirit of the present invention.

Figure 3A:
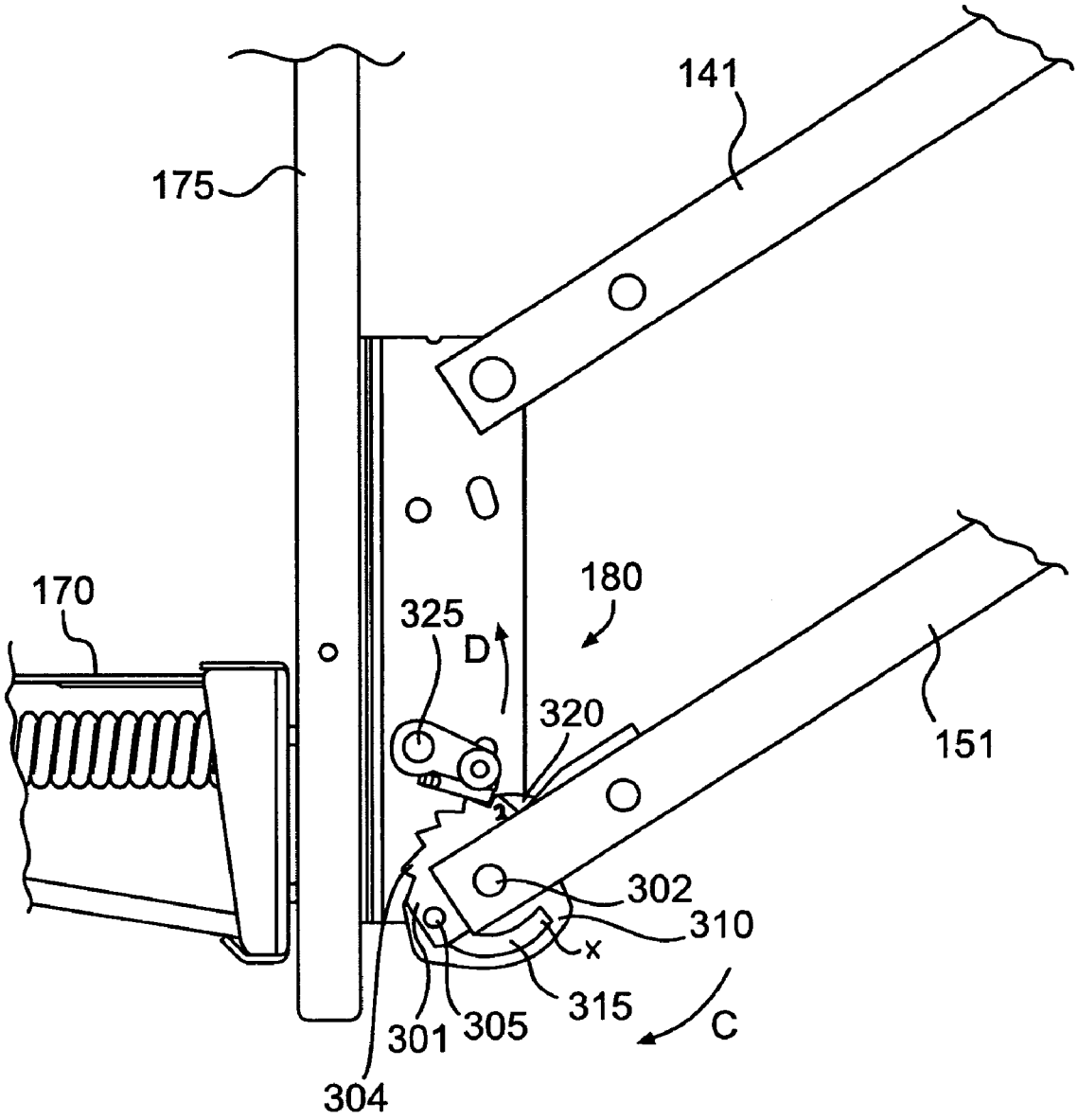
FIGS. 3A-3E illustrate the incremental adjustment of the vertical height of the basketball backboard and hoop according to an embodiment of the present invention.

The operation of the ratchet elevator system of the present invention will now be described with regard to FIGS. 3A-4B. FIGS. 3A-3E illustrate the incremental adjustment of the vertical height of the basketball backboard according to an embodiment of the present invention. FIG. 3A illustrates the basketball backboard 175 and hoop 170 at its second-lowest adjustable height and FIG. 3E illustrates the basketball backboard 175 and hoop 170 at the highest adjustable height, with intermediate height adjustments illustrated in FIGS. 3B to 3D.

FIG. 3A illustrates the pawl 320 engaging with tooth 2 of the toothed edge 304 and, as such, the basketball backboard 175 located at its second-lowest adjustable height. Under the weight of the backboard 175 and hoop 170, the first end of each of the elevator arms 141, 151 have a tendency to rotate downward about their point of connection with the support pole 120 (as shown in FIG. 1). However, as shown in FIGS. 3A-3E, the pawl 320 may engage with any one of the teeth 1-6 of the toothed edge 304 of the ratchet 301 so as to prevent further downward rotation by the elevator arms 141, 151. Therefore, when the pawl 320 is engaged with any one of the teeth 1-6 of the toothed edge 304, the basketball backboard and hoop 170 may be held at a selected vertical height for gameplay.

When a user desires to raise the basketball backboard 175 and hoop 170, a downward force is applied to the adjustment pole 160 in the direction of Arrow A (as shown in FIG. 1). The downward force causes the upper elevator arms 141, 142 and the lower elevator arms 151, 152 to pivot about their rotatable connections to accommodate adjustment of the vertical height of the backboard 175 and hoop 170. During this adjustment, lower elevator arm 151 and ratchet 301 rotate about pin 302 in the direction of Arrow C such that the teeth 1-6 of the toothed edge 304 rotate under the pawl 320. Consequently, the pawl 320 rotates about pin 325 in the direction of Arrow D until the pawl 320 falls into engagement with the next tooth of the toothed edge 304.

Once the pawl 320 falls within the next tooth of the toothed edge 304, the force applied to the adjustment pole 160 may be removed and the engagement of the pawl 320 with one of the teeth 1-6 of the toothed edge 304 prevents further rotation of the elevator arms 141, 151 and ratchet 301. As a result, the basketball backboard 175 and hoop 170 are held at a pre-selected height above the playing surface. This process may be repeated, incrementally raising the height of the basketball backboard 175 and hoop 170.

Figure 3B:
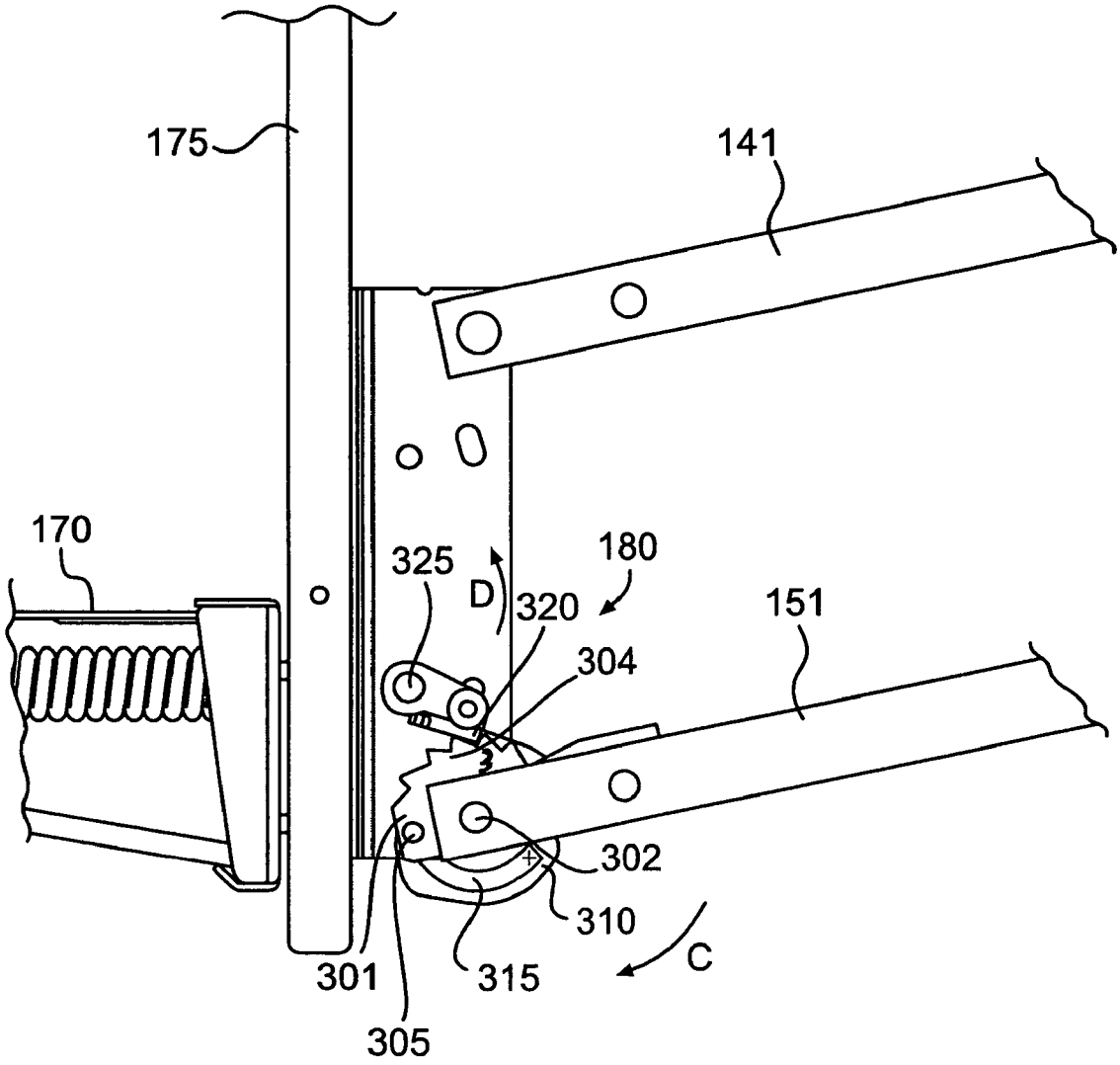
Figure 3C:
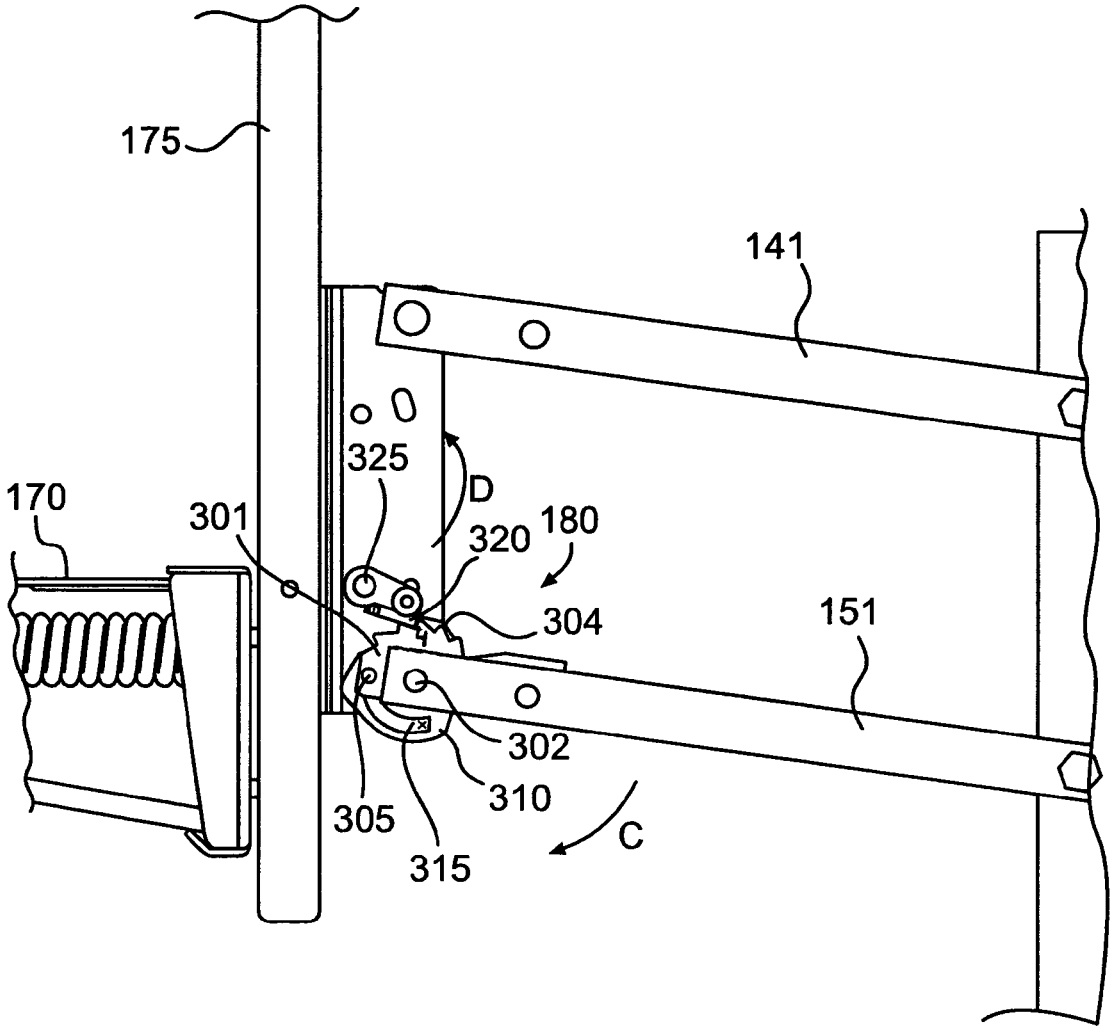
Figure 3D:
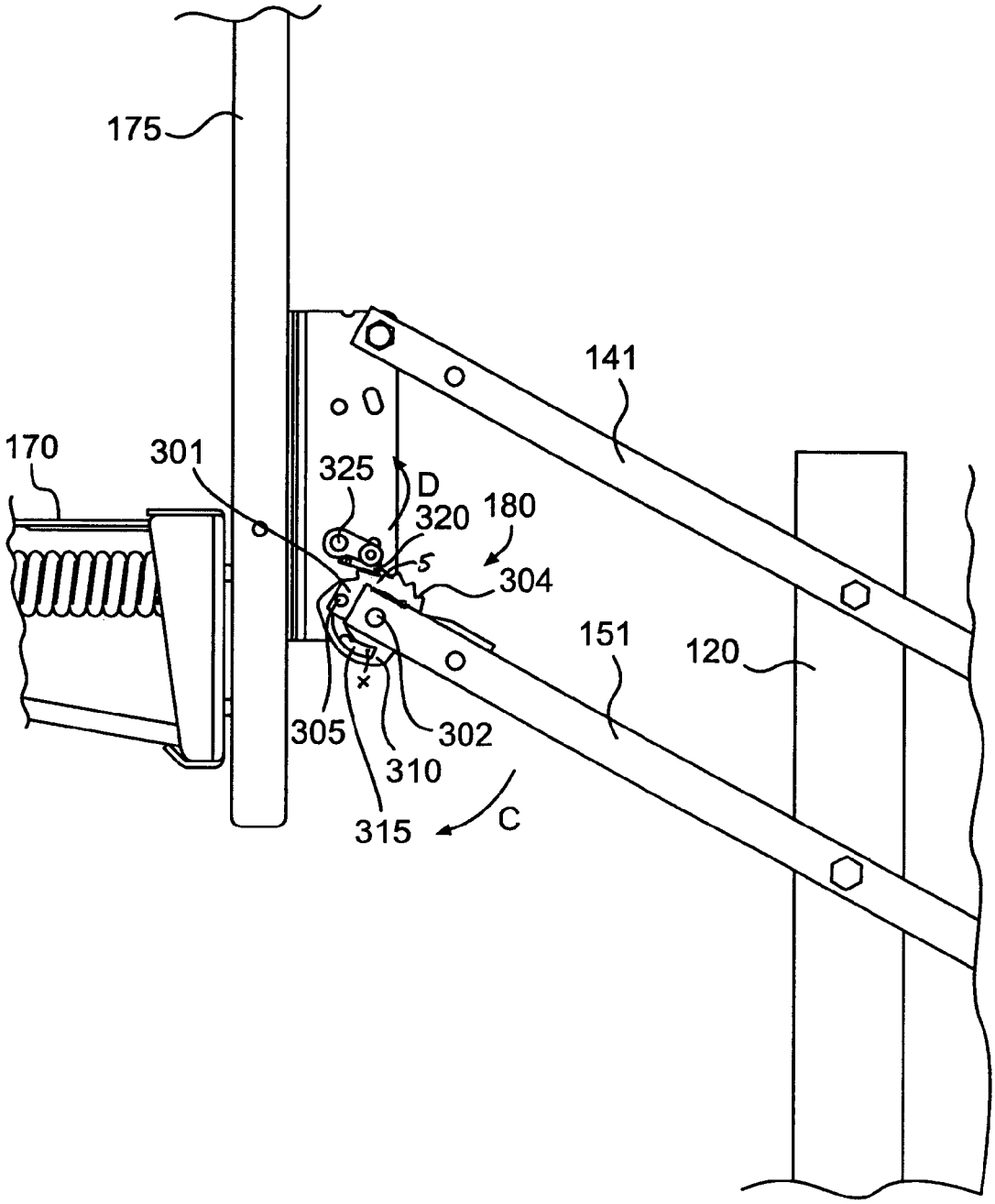
Figure 3E:
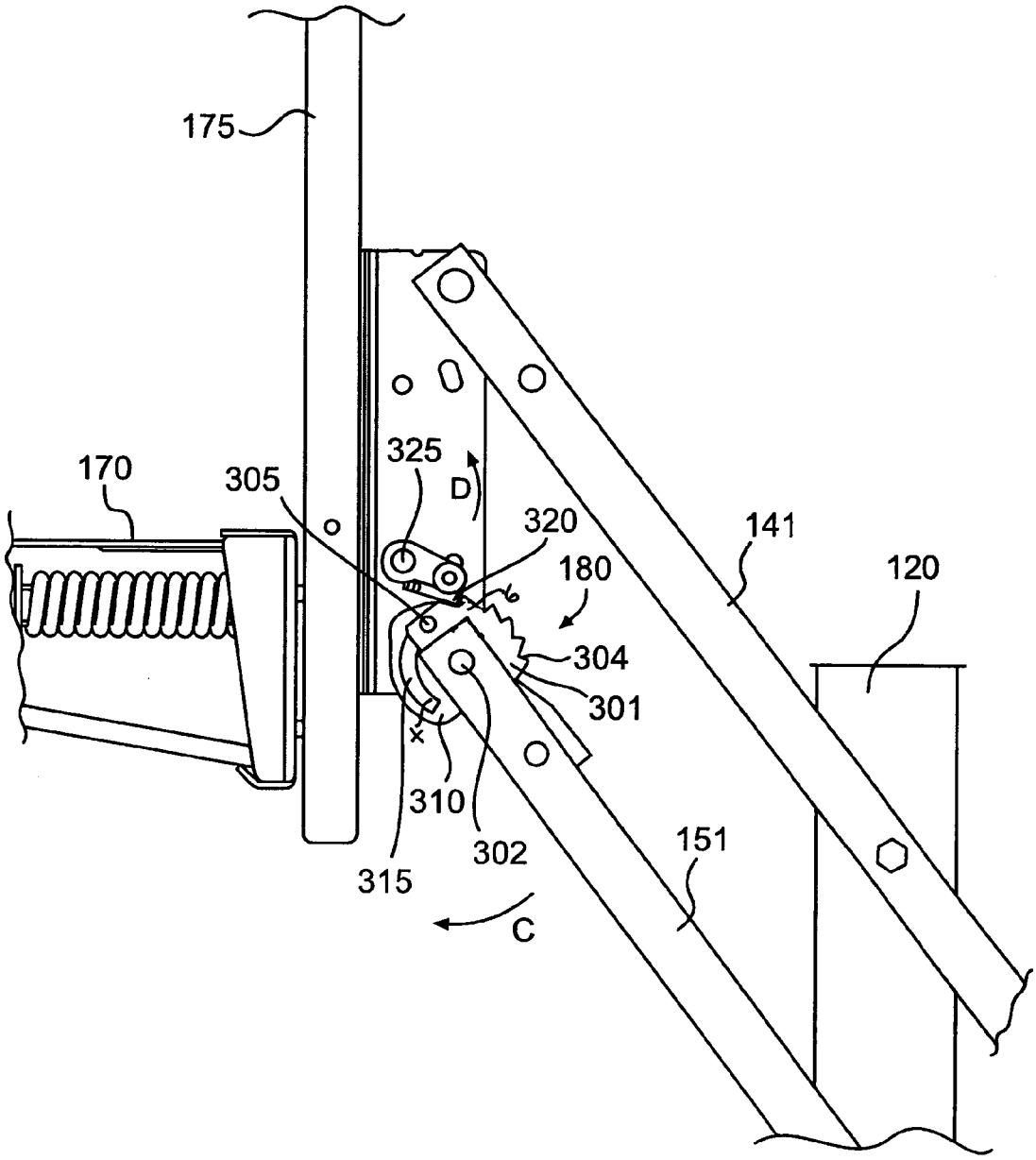

A comparison of FIG. 3A with FIG. 3B illustrates the incremental adjustment in the height of the basketball backboard 175 and hoop 170 according to the present invention. FIG. 3A shows pawl 320 in engagement with tooth 2 of the toothed edge 304. When a user applies a downward force to the adjustment pole 160, the elevator arms 141, 151 rotate about point 302 in the direction of Arrow C, causing the pawl 320 to rotate about pin 325 in the direction of Arrow D. The rotation of the elevator arms 141, 151 may continue until pawl 320 can fall into engagement with tooth 3, as shown in FIG. 3B. If a user elects to remove the force in the direction of Arrow A on adjustment pole 160, the pawl 320 remains engaged with tooth 3 of the toothed edge and the basketball backboard 175 and hoop 170 remain at the vertical height illustrated in FIG. 3B. Alternatively, the user may continue to apply force to the adjustment pole 160 which incrementally adjusts the height of the basketball backboard 175 and hoop 170 to any of the higher positions shown in FIGS. 3C, 3D or 3E. This process may be repeated until the basketball backboard 175 and hoop 170 reaches their maximum adjustable vertical height above the playing surface.

As illustrated in FIG. 3E, when the pawl 320 engages with the final tooth 6 of the toothed edge 304, the basketball backboard 175 and hoop 170 may be held at the maximum adjustable vertical height above the playing surface. At this point, the user may choose to allow the basketball backboard 175 and hoop 170 to remain at the highest height or may choose to lower the backboard 175 and hoop 170 back down to its lowest vertical height where the pawl 320 engages with tooth 1 of the toothed edge 304 of the ratchet 301.

Figure 4A:
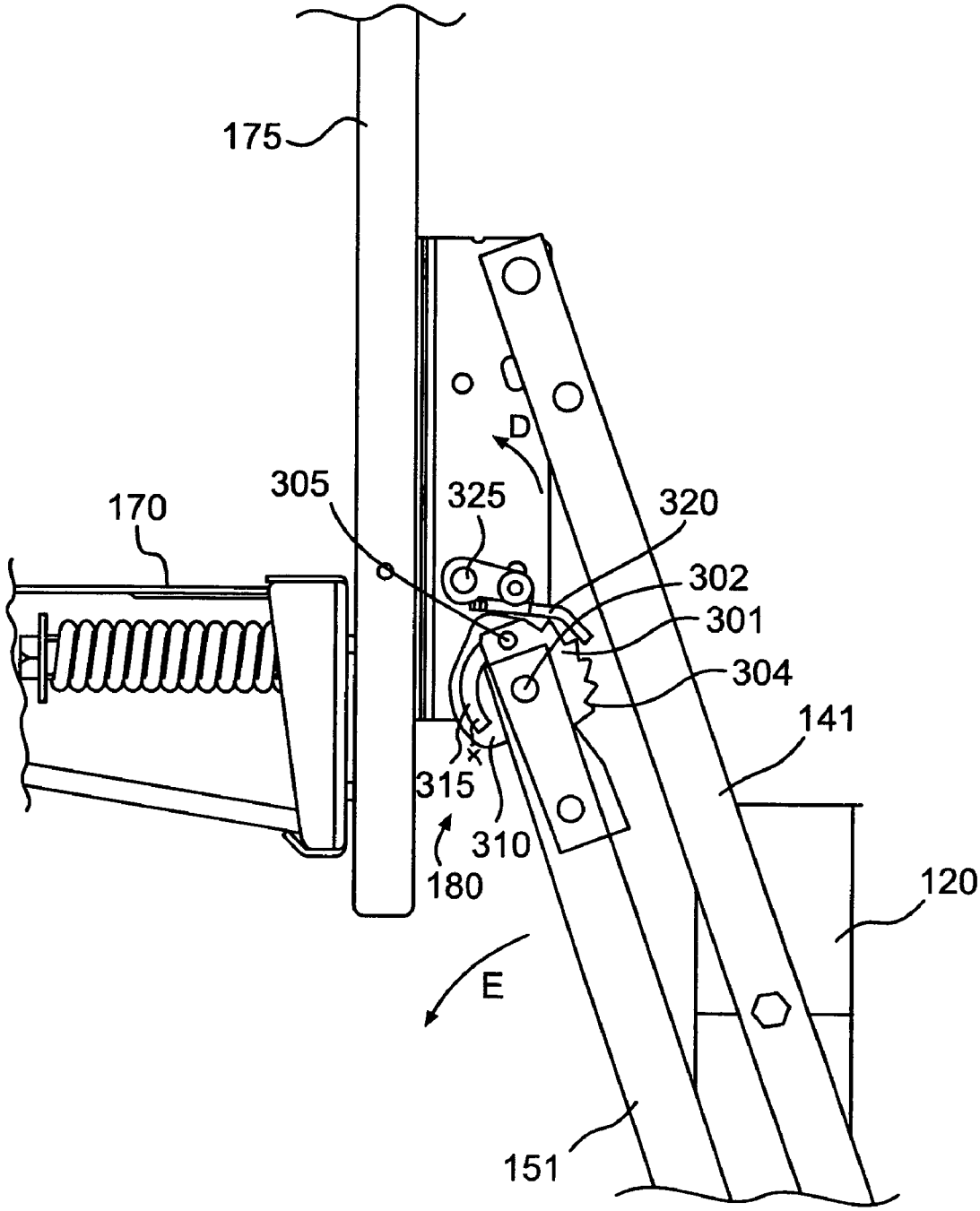
FIGS. 4A and 4B illustrate how a player may use the present invention to lower a basketball backboard and hoop from its maximum adjustable height.
Figure 4B:
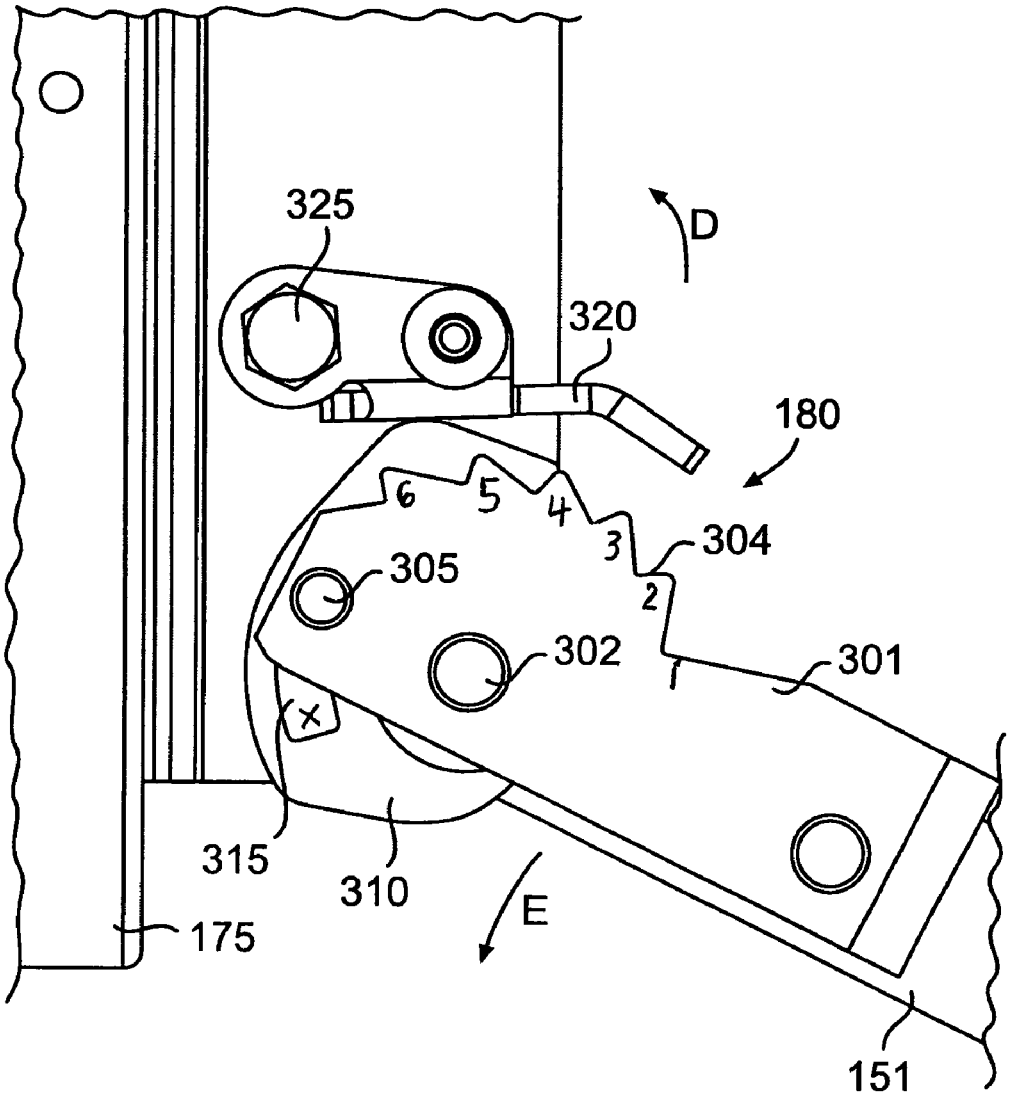

FIGS. 4A and 4B illustrate how a player may use the present invention to lower the basketball backboard 175 and hoop 170 from the maximum adjustable height. When the backboard 175 and hoop 170 reach the maximum vertical height, additional downwards force on the adjustment pole 160 causes pin 305 to exert a force on one end of the elongated slot 315 of the cam 310. This force causes the cam 310 to force the pawl 320 to rotate about pin 325 in the direction of Arrow D. This rotation results in the pawl disengaging from the teeth 1-6 of the toothed edge 304 of the ratchet 301 as illustrated in FIG. 4A.

Once the pawl 320 is disengaged from the teeth 1-6 of the toothed edge 304, a user may lower the vertical height by allowing the basketball backboard 175 and hoop 170 to lower under its own weight or by exerting an upward force on the adjustment pole 160. As the elevator arms 141, 151 and ratchet 301 pivot in the direction of Arrow E, the cam 310 remains stationary as the elongated slot 315 permits the ratchet 301 to move relative to the cam 310. As shown in FIG. 4B, the cam 310 continually holds the pawl 320 above the toothed edge 304 as the teeth 1-6 of the toothed edge pass below the pawl 320. Consequently, the cam 310 prevents the pawl 320 from engaging with any of the teeth 1-6 the toothed edge 304 and allows the user to lower the backboard 175 and hoop 170.

When the backboard 175 and hoop 170 almost reach the lowest vertical height, pin 305 may engage the bottom end X of the elongated slot 315. This, in turn, causes the cam 310 to rotate counterclockwise with respect to the ratchet 301. The shape of the cam 310 may be such that, when the backboard 175 and hoop 170 reach the lowest vertical height, the pawl 320 is forced to engage with ratchet tooth 1 because the cam 310 may no longer lift the pawl 320 above the toothed edge 304. Once the pawl 320 engages with tooth 1 of the toothed edge 304, the height of the backboard 175 may again be incrementally increased, as discussed above with regard to FIGS. 3A-3E.

Unlike traditional systems, the use of the ratchet and cam system 180 of the present invention may permit a user to automatically make adjustments in the height of a basketball system using a simple pole or similar device. Because the pawl 320 may automatically disengage from the ratchet teeth 304 to lower the height, a user may not be required to manually disengage a locking mechanism while supporting the weight of the assembly. As such, adjustments in the height of the basketball backboard 175 and hoop 170 may be made quickly and easily.

Further, it should be noted that the ratchet 301, cam 310 and pawl 320 are of simple design and may be fabricated using readily available materials. As such, the assembly and use of the ratchet and cam system 180 is simple, time-efficient and cost-efficient.

The foregoing descriptions of specific embodiments of the present invention are presented for purposes of illustration and description. They are not intended to be exhaustive or to limit the invention to the precise forms disclosed. Obviously, many modifications and variations are possible in view of the above teachings. While the embodiments were chosen and described in order to best explain the principles of the invention and its practical applications, thereby enabling others skilled in the art to best utilize the invention, various embodiments with various modifications as are suited to the particular use are also possible. The scope of the invention is to be defined only by the claims appended hereto, and by their equivalents.

What is claimed is:

1. An elevator system for adjusting the height of a basketball backboard above a playing surface, the system comprising:

a basketball support element;

a basketball backboard having at least a first position above said playing surface and a second position above said playing surface, the first position being lower than the second position;

at least one elevator arm rotatably connected to said backboard and rotatably connected to said basketball support element;

a ratchet having a plurality of ratchet teeth, said ratchet being rigidly connected to said at least one elevator arm;

a pawl, said pawl being in engageable relation with the plurality of ratchet teeth when said backboard is at both the first position and the second position and capable of maintaining a position of said backboard above said playing surface; and a cam rotatably connected to said ratchet and said backboard and having an elongated slot, said ratchet being slidably engageable with the elongated slot;

wherein the application of an upward force to said backboard when said backboard is at the first position causes said backboard to move to said second position and the application of an upward force to said backboard when said backboard is at the second position causes said cam to disengage said pawl from said ratchet, preventing said pawl from engaging with the plurality of ratchet teeth and permitting said backboard to move from the second position to the first position.

2. The system according to claim 1, wherein: the elongated slot has a first end and a second end; and said ratchet has a pin in slidable engagement with the slot, the pin engaging the first end of the slot when said backboard is located at the first position and the second position and engaging with the second end of the slot during the movement of said backboard from the second position to the first position.

3. The system according to claim 1, further comprising an adjustment pole for applying an upward force to said backboard.

4. The system according to claim 1, wherein the first position is the lowest possible vertical position of said backboard above said playing surface.

5. The system according to claim 1, wherein the second position is the highest possible vertical position of said backboard above said playing surface.

6. The basketball apparatus of the claim 1, wherein said pawl is biased into engageable relation with the plurality of teeth.

* * * * *